US006173599B1

(12) United States Patent
Stepanenko et al.

(10) Patent No.: US 6,173,599 B1
(45) Date of Patent: Jan. 16, 2001

(54) LEAF SPRING STRAIGHTENING APPARATUS

(75) Inventors: Alexandr Vasylevich Stepanenko; Vladimir Andreevich Korol; Alexandr Pavlovich Grechenko, all of Minsk (RU); Ireneusz Eric Dzieciol, Chatham (CA); J. Christopher Waugh; John Joseph Murtagh, both of Windsor (CA)

(73) Assignee: Oxford Suspension, Inc., Troy, MI (US)

( * ) Notice: Under 35 U.S.C. 154(b), the term of this patent shall be extended for 0 days.

(21) Appl. No.: 09/353,755

(22) Filed: Jul. 14, 1999

Related U.S. Application Data

(63) Continuation-in-part of application No. 09/007,267, filed on Jan. 14, 1998, now Pat. No. 6,012,320.

(51) Int. Cl.[7] ..... B21D 7/02
(52) U.S. Cl. ..... 72/383; 72/298; 72/387
(58) Field of Search ..... 72/218, 298, 387, 72/386, 388, 383; 140/106, 147

(56) References Cited

U.S. PATENT DOCUMENTS

| | | | |
|---|---|---|---|
| 1,066,247 | 7/1913 | Brown, Jr. . | |
| 3,824,834 | 7/1974 | Durham . | |
| 4,716,757 | 1/1988 | McGregor et al. . | |
| 4,798,073 | 1/1989 | Dischler . | |
| 5,001,918 | 3/1991 | Stepanenko et al. . | |
| 5,588,322 | 12/1996 | Passone . | |
| 5,836,193 | 11/1998 | Hunter et al. . | |
| 6,012,320 * | 1/2000 | Stepanenko et al. | 72/383 |

FOREIGN PATENT DOCUMENTS 63-137518 9/1988 (JP) .

* cited by examiner

*Primary Examiner*—David Jones
(74) *Attorney, Agent, or Firm*—Dykema Gossett PLLC

(57) ABSTRACT

An apparatus for straightening a U-shaped leaf spring wherein the spring includes a curved section having a concave side and a convex side and wherein the spring has a pair of elongated legs spaced-apart relationship with each other from the curved section of the spring and the curved section of the spring has a radius of curvature adjacent a side of the legs facing away from each other, the apparatus comprising a plurality of pivotal block members which simultaneously rotate counter to one another, each of the blocks having a channel disposed thereon adapted to receive one of the leaf spring legs therein and the channel having an outer wall facing toward the other block outer wall which extends away from the curved section of the leaf spring to a respective free end such that the combined lengths of the outer walls on both blocks are substantially the same length of the convex side of the curved section of the leaf spring; each block channel having a respective inner wall facing away from the inner wall of the opposite block and facing a concave side of the leaf spring legs and adapted to engage and provide support to the concave curved section of the leaf spring during the straightening process; a mechanism to rotate the blocks and straighten out the leaf spring; and a ram to support the curved section of the leaf spring.

15 Claims, 6 Drawing Sheets

LEAF SPRING STRAIGHTENING APPARATUS

The present invention is a continuation-in-part of prior application Ser. No. 09/007,267, filed Jan. 14, 1998, now U.S. Pat. No. 6,012,320.

BACKGROUND OF THE INVENTION

Although not limited to the particular folding or bending processes disclosed in U.S. Pat. No. 5,001,918, the disclosure of which is incorporated herein by reference, the apparatus of the present invention is particularly applicable thereto as the processes disclosed therein related to apparatus for simultaneously tapering opposite ends of a heated leaf spring during which the heated leaf spring is straightened after having been folded or bent into a substantially flat "U" Shaped configuration of which the coinventors of the present invention are amongst the coinventors of U.S. Pat. No. 5,001,918.

The straightening apparatus of the present invention provides however an improvement over the straightening apparatus disclosed in U.S. Pat. No. 5,001,918 in that it is adapted to prevent warpage from occurring at the fold or curved section of the leaf spring during the straightening process.

BRIEF DESCRIPTION OF THE INVENTION

Accordingly, it is an object of this invention to provide apparatus for straightening a heated folded leaf spring.

It is another object of the invention to provide apparatus for straightening a heated leaf spring folded into a substantially flat "U" shaped configuration during a process for simultaneously tapering opposite ends thereof.

It is another object of the invention to provide apparatus operative to prevent warpage from occurring at a central curved section of a heated leaf bent or folded into a substantially flat "U" shaped configuration during a process for simultaneously tapering opposite ends thereof.

DETAILED DESCRIPTION OF THE INVENTION

Figure 1:
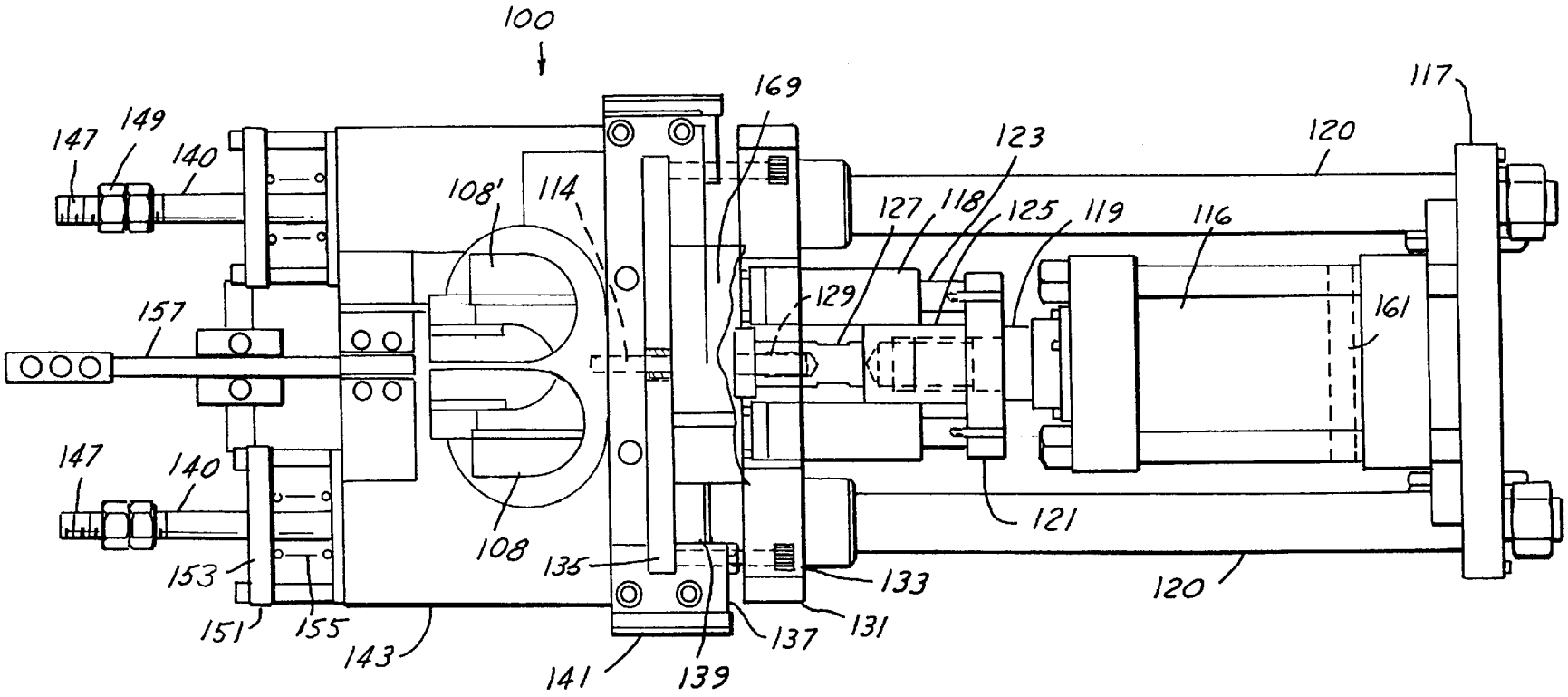
FIG. 1 is a top elevational view of a machine taken along view line 1—1 in FIG. 2 operating a preferred embodiment of apparatus for the invention referenced by numeral 100.
Figure 2:
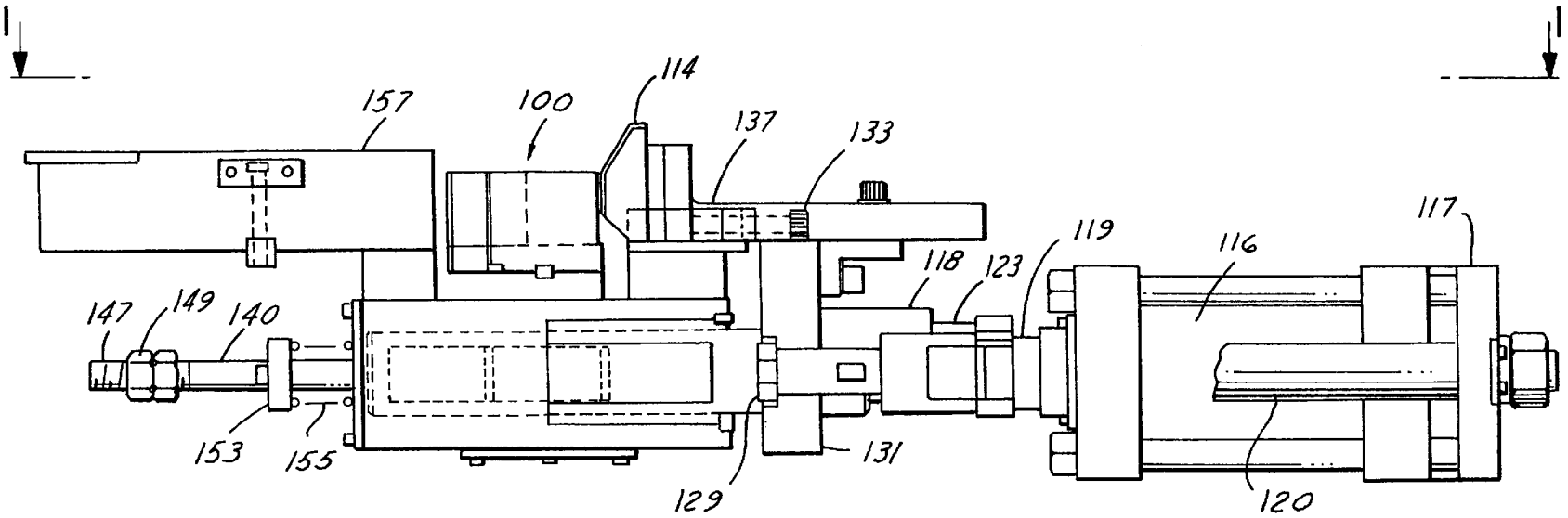
FIG. 2 is a side elevational view of the machine of FIG. 1.

Referring to FIGS. 1–6, apparatus 100 includes a hydraulic cylinder 116. The hydraulic cylinder 116 has one end abutting or connected to a plate 117. The plate is connected to apair of spaced-apart shafts 120. The cylinder 116 has a multi-diameter piston rod 119. The piston rod 119 has a fixably connected plate 121. The plate 121 is affixed with two plungers 123. The plungers 123 are engaged into a nitrogen charged compliant cylinder or spring cylinder 118. Pivotal blocks 108, 108' (as best shown in FIGS. 4A–4C) are operative to straighten a heated fluid leaf spring having a pair of spaced-apart legs 106 and 106' that is heated to a red state at a temperature of typically between 1600 F. and about 2200 F. The legs 106 and 106' taper away from opposite ends of a curved section 124 having a convex side 26 and a concave side 28. The heated leaf spring has a center radius designated as 0.

The curved section 124 has a radius of curvature "r" whose origin "O" is located at the intersection of orthogonal axis "x" and "y" of which the axis "y" bisects the space between the legs 106 and 106'.

Returning to FIG. 1, the cylinder rod 119 has a section 125 which is connected with the plate 121. Extending forward of section 121 is a piston rod section 127. Piston rod 127 has a positioning adjusted theradably mounted set screw 129. The previously mentioned nitrogen charged springs 118 are fixably connected with a plate 131. Plate 131 has fixably connected thereto on its top end push rods 133. Push rods 133 abut ram plate 135 and are aligned by insertion through an alignment plate 137 which has an aperture 139. The alignment plate 137 is fixably connected with a frame member 141. The frame member 141 is also fixably connected with a forward frame 143. The forward frame 143 has pivotally mounted thereon block members 108 and 108'. The block members 108 and 108' on their underside are fixably connected with pinion gears 136 and 136' (FIG. 5) respectively. The shafts 120 at their forward end are connected with inwardly facing racks 140. The racks 140 have rack teeth 142. The racks 140 at their extreme end have a threaded portion 147. The threaded 147 has two positioning nuts 149 threadably connected thereto. Connected with frame portion 143 and surrounding the rack 140 is a spring cage 151. The spring cage 151 has a plate 153 that captures a spring 155. A presentation rack 157 aids in guiding the leaf spring to the leaf spring unfolding apparatus 100.

Figure 4C:
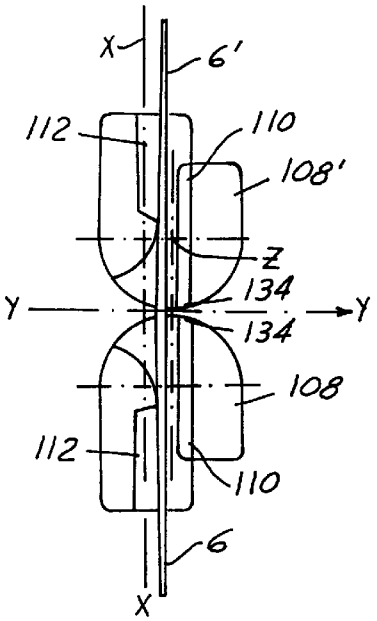
FIGS. 4A–4C are schematic diagrams of the process by which apparatus 100 straightens a folded heated leaf spring.
Figure 4B:
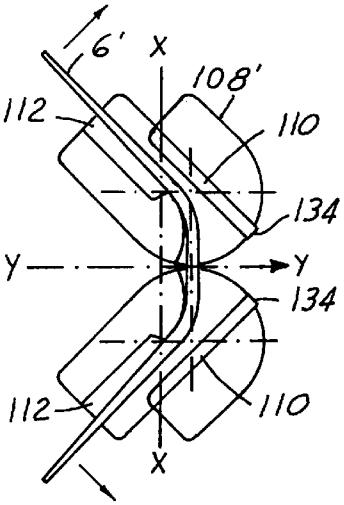
Figure 4A:
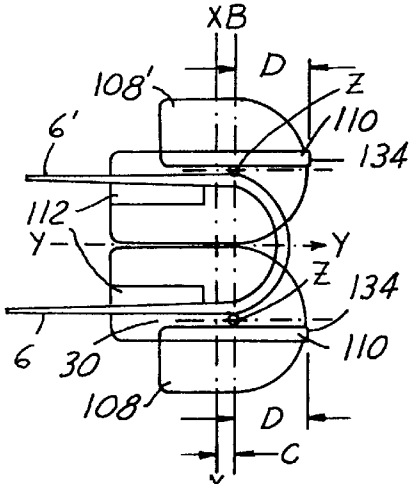
Figure 3:
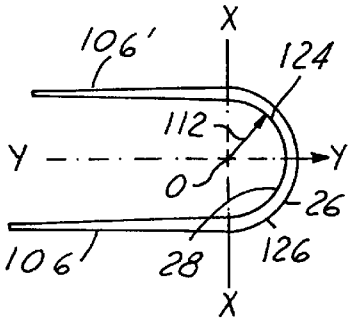
FIG. 3 is a plan elevational view of a folded leaf spring prior to being straightened by apparatus 100.

FIGS. 4A and 4C are shown having a pair of spaced apart rotary block members 108 and 108' having respective rotational axis "z" and "z'" that are displaced rearwardly from the axis "x". The rotational axis of the block members are generally equal distance from the "y" axis. The rotational axis "z" and "z'" are outwardly adjacent the sides of the legs 6 and 6' facing away from each other.

Figure 6:
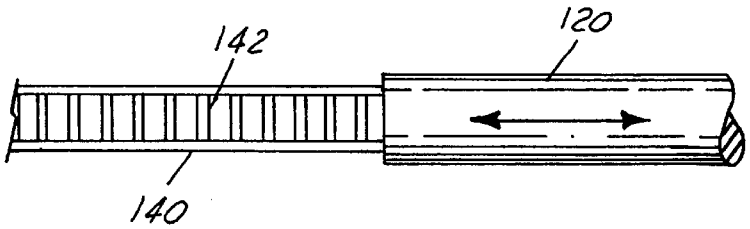
FIG. 6 is a side elevational view of the mechanism of FIG. 5 taken along view line 6—6.
Figure 5:
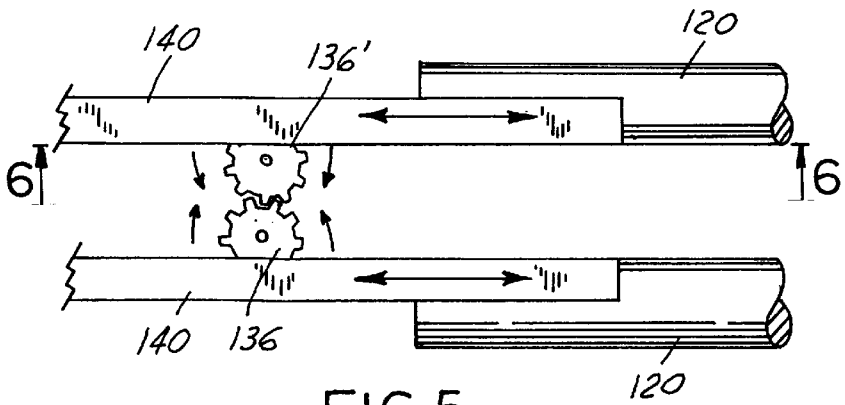
FIG. 5 is a partial top elevational view of a preferred mechanism for rotating certain components of apparatus 100 in the form of a pair of racks (40,40') and pinions (36, 36').
Figure 8:
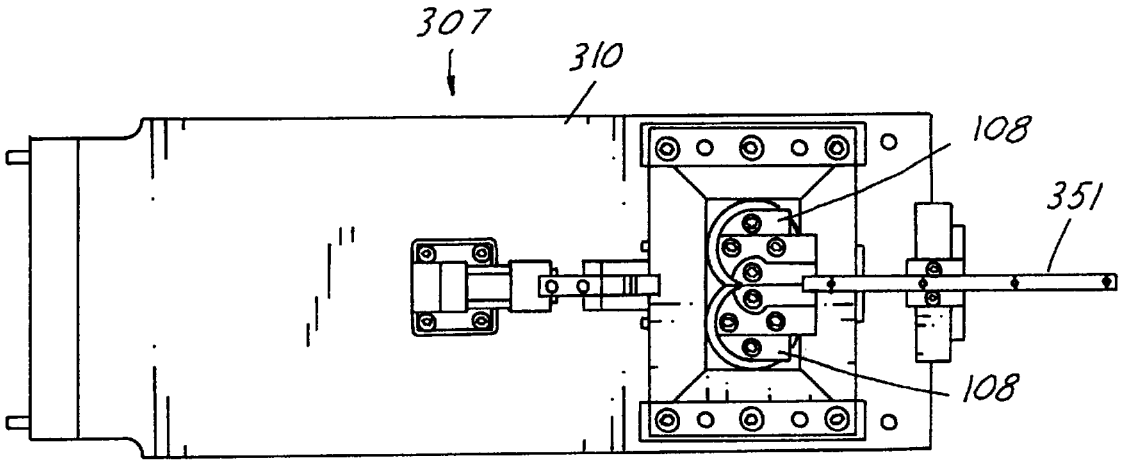
FIG. 8 is a top elevational view of the apparatus shown in FIG. 7.
Figure 7:
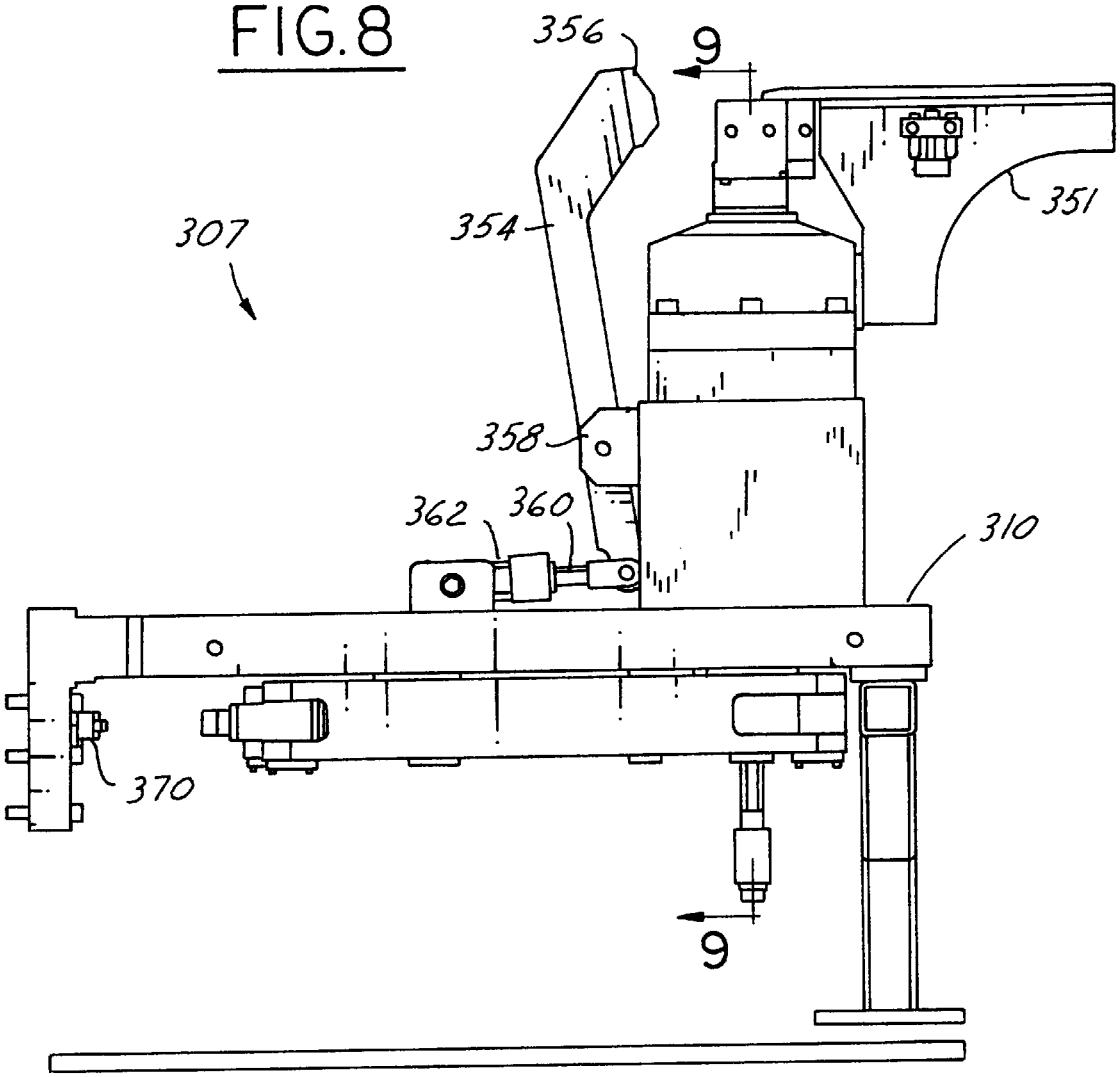
FIG. 7 is a side elevational view of an alternate preferred embodiment apparatus for unfolding a leaf spring according to the present invention.

Block members 108 and 108' are rotated in unison in opposite directions by means of the rack and pinion arrangement as shown in FIGS. 5 and 6.

In operation, the right side of piston 161 of cylinder 116 is exposed to pressure. The cylinder is relatively heavy as compared with the other components. Therefore, the piston rod 119 will be urged to the left pushing plate 121. Plate 121 via plungers and spring 118 urge plate 131 to the left. Plate 131 urges the two push rods 133 against the ram plate 135 and moves the ram 114 to push the leaf spring into position. Prior to the activation of the cylinder 116, the hot leaf spring will be presented over the presentation rack 157 to fall into position into the block members 108 and 108'. Further movement of the piston rod 119 causes the ram 114 to position the leaf spring fully within the blocks 108 and 108' as shown in FIG. 4A. The springs 118 give compliance to the ram 114. After the ram 114 has placed the leaf spring into position as shown in FIG. 4A, the piston rod will proceed to the left until the positioned set screw contacts plain wall 169 of the frame member 141. The set screw 129 can set the amount of travel of the piston rod 119 to the left to fine tune the adjustment to set the amount of travel of the piston rod 119 after the ram has fully set the leaf spring in the block members 108 and 108'.

After the piston rod positional set screw 129 has seated against the surface 169 further fluid delivery to the cylinder 116 will cause the cylinder 116 to move the plate 117 to the right. The rightward movement of plate 117 will pull shafts 120 to the right. The movement of shafts 120 to the right will cause the gear 136 to rotate in a counter-clockwise manner and for the gear 136' to rotate in a clockwise manner. The rotation of the block members 108 and 108' will be synchronized by the meshing of the pinion gears 136 and 136'.

Referring back to FIGS. 4A–4C, the block members 108 and 108' include channels 130 therein that at the start of the straightening process are positioned to respectively receive the legs 6 and 6' of the folded heated leaf spring thereon.

Channels 130 have respective outer walls 110 that extend beyond a line B intersecting the pivotal axis of the blocks for a distance "D" to free ends 134 such that the sums of both distances to D is substantially the same as the length of the convex side 126 of the curved section 124 of the folded heated leaf spring. However, the distances to D is subtracted somewhat to allow for a gap for entry of the support ram 114.

The channels 30 include inner walls 112 on the concave side of curved section 124 that extend for a predescribed distance towards the line B and then turn angularly toward each other as best shown in FIGS. 4A–4C such that they slidably release from the concave side of curved section 24 during the straightening process. As mentioned previously, as the cylinder 116 moves to the right, the block 108 rotates counter-clockwise and the block 108' rotates clockwise. The support ram at all times pushes against the heated leaf spring. Since the rotational axis of the block 108 and the block 108' are rearward of the radius of curvature "O" or rearward of the axis "X" there is relative sliding movement between the inner walls 112 and the legs 6 and 6' as the blocks 108 and 108' straighten the heated leaf spring. This relative linear movement between the inner walls 112 against the legs 6 causes a frictional tensional force which pulls the heated leaf spring axially outward. This tensional force upon the heated leaf spring causes the spring to have a straighter resultant product than as would be the case without this frictional force. To further prevent warpage the ram 114 continually applies force upon the heated leaf spring.

At the end of the straightening process as shown in FIG. 4C, the cylinder 116 is shifted to a fluidly neutral position and the springs 155 will push against the position of set washer 149 to push the shafts 120 to the left to incrementally back off the blocks 108 and 108' so that the leaf spring may be pulled out from the channels 130.

Figure 9:
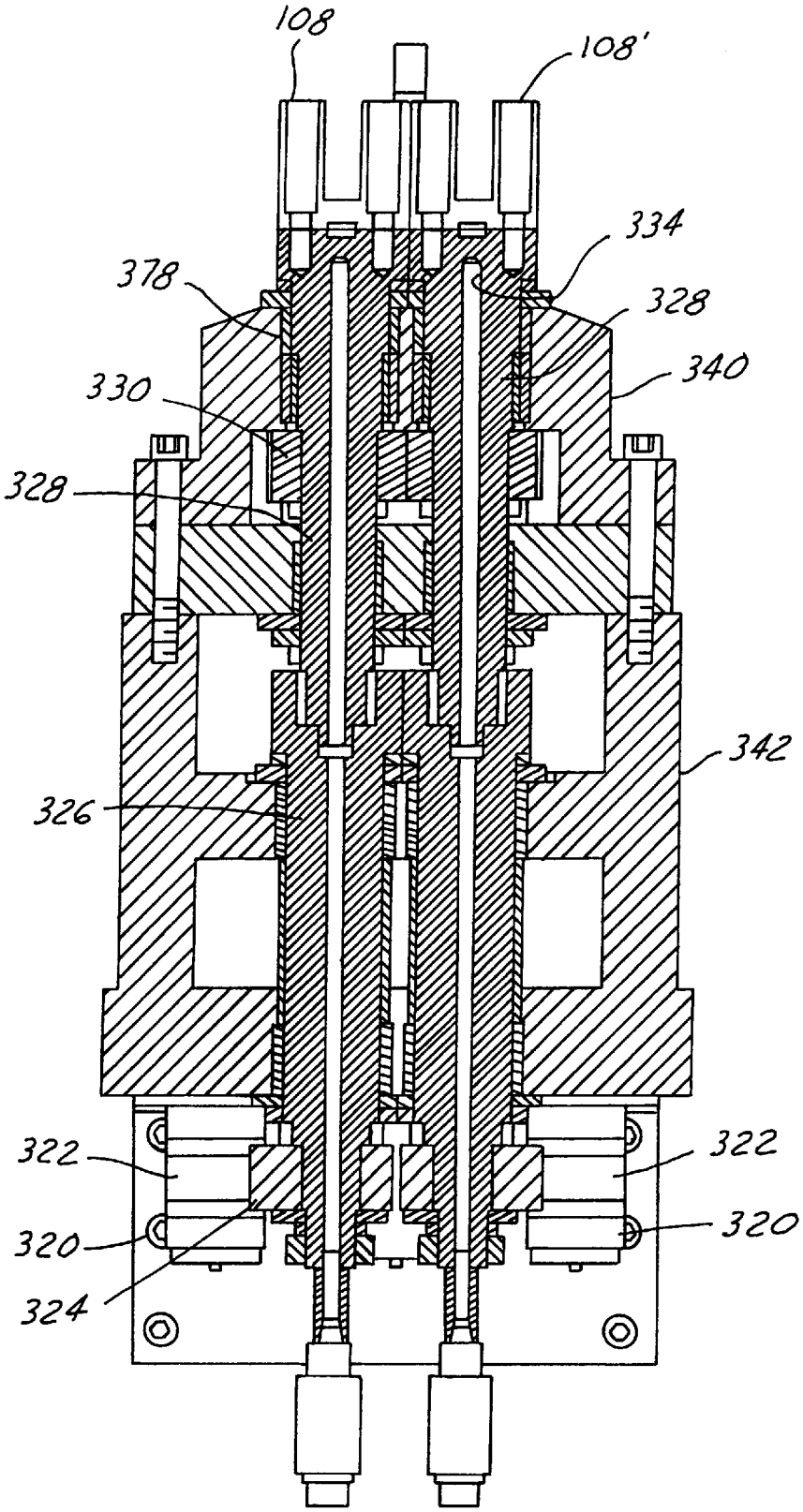
FIG. 9 is a view taken along lines 9—9 of FIG. 7.
Figure 11:
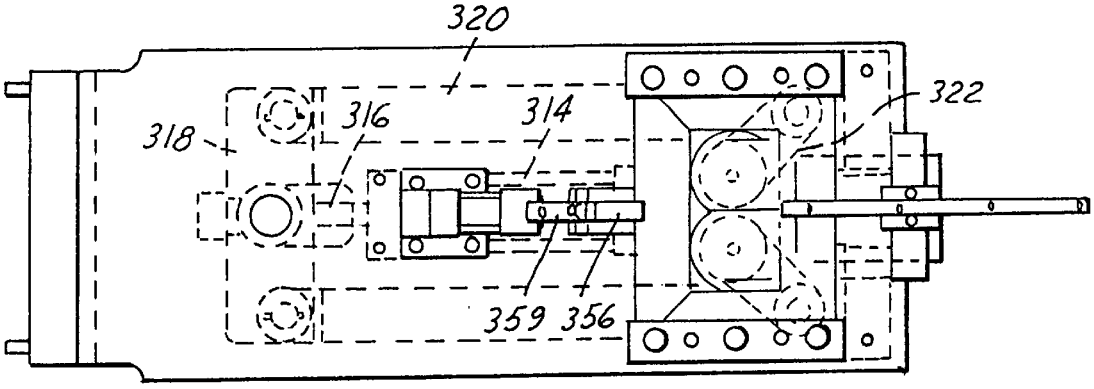
FIG. 11 is a view similar to that of FIG. 8 illustrating additional detail.
Figure 10:
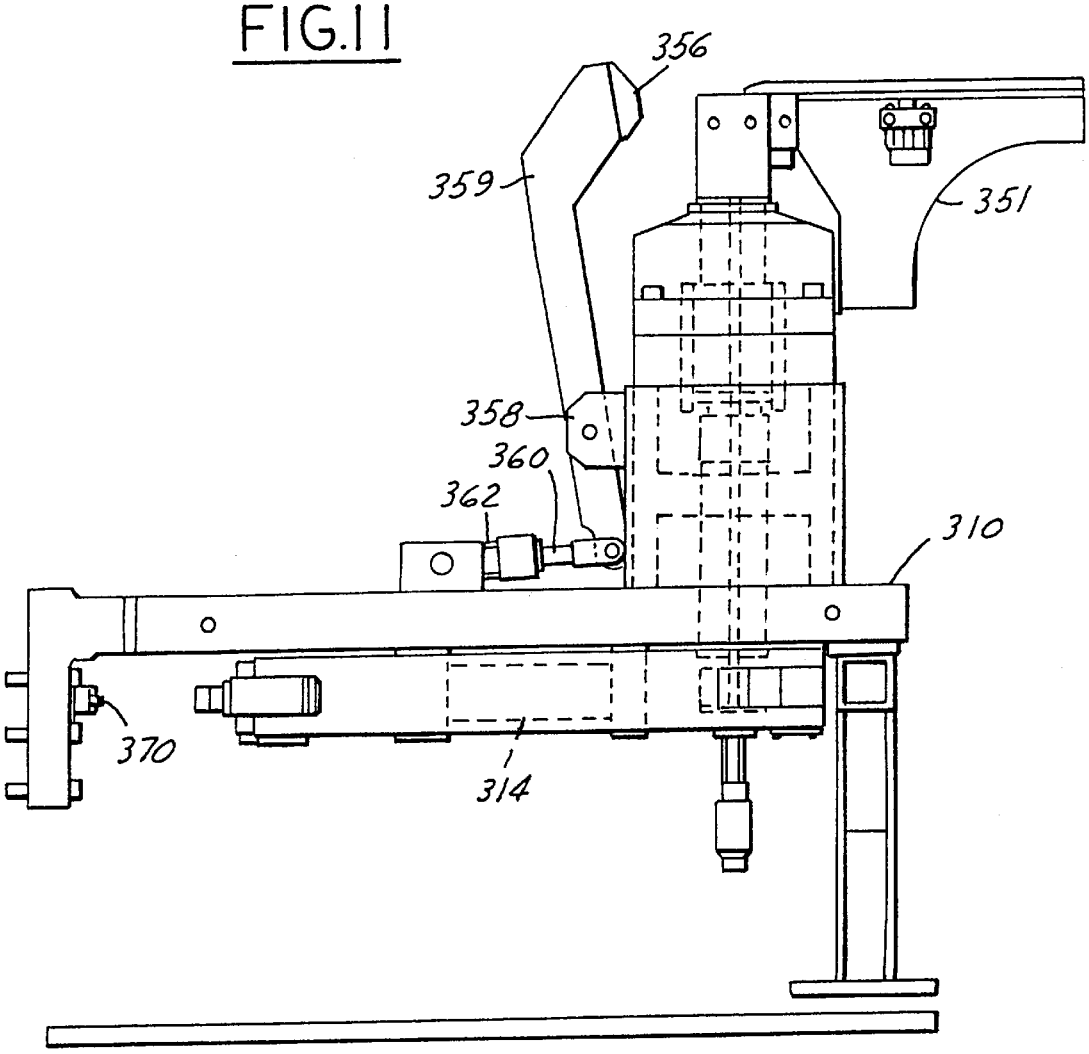
FIG. 10 is a view similar to that of FIG. 7 illustrating additional detail.

FIGS. 7–11 illustrate an alternate preferred embodiment of the present invention which is more tolerant of the high heat condition of the folded leaf spring. The apparatus 307 has two pivotal blocks whose shape and function are substantially similar if not identical to the blocks 108, 108' described in FIGS. 4A–4C. The apparatus 307 has a frame 310. Mounted underneath the frame 310 is a cylinder 314. The cylinder 314 has a rod 316. The rod 316 is connected with a plate 318. Plate 318 is pivotally connected with a secondary lever 320. The secondary lever is pivotally connected with the second end of a primary lever 322. The primary lever has its first end torsionally fixed to a lower shaft 326. The lower shaft 326 is torsionally connected with an upper shaft 328. The upper shaft 328 is encircled by a timing gear 330 which is enmeshed with a timing gear of another upper shaft. The top of the shafts 328 are fixably connected with two pivotal blocks 108 and 108'. The shafts 326, 328 are hollow, having a passage 334 for insertion of a water tube to allow for cooling of the shafts during operation. The upper shafts 328 and timing gear 330 and blocks 108 are all connected with an upper head 340 which is connected with a lower frame 342 and can be readily changed as required. The mechanism 307 has a leaf spring presentation tray 351. A ram 354 has a head 356 and pivots about pivot mount 358. The ram's lower end is pivotally connected with a piston rod 360 of a hydraulic cylinder 362 which is pivotally mounted to the frame 310. Underneath the lower shafts 326 are the water connection fittings 370 as best shown in FIG. 9. The frame 310 also at an extreme end has a spring stop 370. In operation, the blocks 108 the cylinder 314 extends the rod 316. Extension of the rod 316 causes the plate 318 to move to the left and thereabout causes the secondary lever 320 to pivot the primary lever 322. Pivotal motion of the primary lever 322 causes the lower shaft 326 and upper shaft to rotate. Rotation of the shafts is synchronized by the timing gears 330. The action of the spring 370 acting upon the plate 318 or vice-versa if the spring location is changed, stores a slight amount of energy to back off the blocks 108 at the completion of the operation of the unfolding of the leaf spring. The design as best shown in FIG. 9, allows the bearings 378 and the bushings of the shaft to be isolated from the heat and scale associated with the hot leaf spring. Additionally, the water cooling allows the lubricated grease to provide better operating results. Additionally, maintenance can be achieved in a faster fashion by the removal of the head 340.

We claim:

1. An apparatus for straightening a U-shaped leaf spring wherein the spring includes a curved section having a concave side and a convex side and wherein the spring has a pair of elongated legs spaced-apart relationship with each other from the curved section of the spring and the curved section of the spring has a radius of curvature adjacent a side of the legs facing away from each other, the apparatus comprising:

a plurality of pivotal block members which simultaneously rotate counter to one another, each of the blocks having a channel disposed thereon adapted to receive one of the leaf spring legs therein and the channel having an outer wall facing toward the other block outer wall which extends away from the curved section of the leaf spring to a respective free end such that the combined lengths of the outer walls on both blocks are substantially the same length of the convex side of the curved section of the leaf spring; each block channel having a respective inner wall facing away from the inner wall of the opposite block and facing a concave side of the leaf spring legs and adapted to engage and provide support to the concave curved section of the leaf spring during the straightening process;

a mechanism to rotate the blocks and straighten out the leaf spring; and a ram to support the curved section of the leaf spring.

2. The apparatus of claim 1 wherein the rotary block members are rotated simultaneously by a rack and pinion mechanism.

3. The apparatus of claim 2 wherein the rack and pinion mechanism has a pinion associated with each pivotal block member and the pinion mechanisms are meshed in synchronization with one another.

4. The apparatus of claim 1 wherein the leaf spring has an axial center line intersection, a curved section center of radius and the center of rotation of the pivotal block members are rearward of a line drawn generally perpendicular to the axial center line of the leaf spring intersection the leaf spring center of radius.

5. The apparatus of claim 1 wherein the ram has compliance.

6. The apparatus of claim 1 wherein the outer walls have a slot between them and the ram passes through the slot to support the leaf spring.

7. The apparatus of claim 1 wherein a common piston and hydraulic cylinder moves the ram and the mechanism to rotate the blocks to straighten out the leaf spring.

8. The apparatus of claim 1 wherein the mechanism to rotate the blocks includes an elongated shaft torsionally connected with each pivotal block, the shaft being fixably connected with a first lever arm along the lever arm first end, the first lever arm having a second lever pivotally connected to a second end, and the second lever being operatively connected with a fluid cylinder.

9. The apparatus of claim 8 wherein the gear shafts have meshing gears to synchronize them.

10. The apparatus of claim 8 wherein the gears are fluid cooled.

11. An apparatus as described in claim 8 wherein said second links are connected to a common plate and the plate is connected with a rod of the cylinder.

12. The apparatus of claim 8 wherein the shafts have an upper section and a lower section and the upper section is mounted in a common head fixably connected to a lower section of a frame.

13. The apparatus of claim 1 wherein the ram is pivotally mounted to a frame and pivotally connected with a fluid cylinder.

14. An apparatus as described in claim 13 wherein the plate is spring mounted on one end and when the rod of the cylinder is fully extended the plate stores energy into a spring captured between the plate and a frame member.

15. An apparatus for straightening a U-shaped leaf spring wherein the spring includes a curved section having a concave side and a convex side and wherein the spring has a pair of elongated legs spaced-apart relationship with each other from the curved section of the spring and the curved section of the spring has a radius of curvature adjacent a side of the legs facing away from each other and wherein the leaf spring has an axial center line, the apparatus comprising:

a plurality of pivotal block members which simultaneously rotate counter to one another, each of the blocks having a channel disposed thereon adapted to receive one of the leaf spring legs therein and the channel having an outer wall facing toward the other block outer wall which extends away from the curved section of the leaf spring to a respective free end such that the combined lengths of the outer walls on both blocks are substantially the same length of the convex side of the curved section of the leaf spring; each block channel having a respective inner wall facing away from the inner wall of the opposite block and facing a concave side of the leaf spring legs and adapted to engage and provide support to the concave curved section of the leaf spring during the straightening process;

and wherein a line perpendicular of the axial center line of the leaf spring intersecting a radial center of the curved section of the leaf spring is forward of center of rotation of the pivotal block members.

* * * * *